US006315398B1

(12) United States Patent
Burke et al.

(10) Patent No.: US 6,315,398 B1
(45) Date of Patent: Nov. 13, 2001

(54) THERMAL INK JET HEATER DESIGN

(75) Inventors: Cathie J. Burke, Rochester; Narayan V. Desphande, Penfield; William G. Hawkins; Dale R. Ims, both of Webster; Michael P. O'Horo, Fairport; Gary A. Kneezel, Webster; Thomas A. Tellier, Williamson; Ivan Rezanka, Pittsford, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 07/963,969

(22) Filed: Oct. 21, 1992

(51) Int. Cl.[7] ..... B41J 2/05
(52) U.S. Cl. ..... 347/64
(58) Field of Search ..... 346/140 R; 347/64, 347/59, 61

(56) References Cited

U.S. PATENT DOCUMENTS

| | | | | |
|---|---|---|---|---|
| 4,532,530 | | 7/1985 | Hawkins | 347/62 |
| 4,638,337 | | 1/1987 | Torpey et al. | 347/65 |
| 4,723,129 | * | 2/1988 | Endo et al. | 346/1.1 |
| 4,774,530 | | 9/1988 | Hawkins | 347/63 |
| 4,835,553 | | 5/1989 | Torpey et al. | 347/63 |
| 4,935,752 | | 6/1990 | Hawkins | 347/62 |
| 4,951,063 | * | 8/1990 | Hawkins et al. | 346/1.1 |
| 5,041,844 | | 8/1991 | Deshpande | 347/65 |
| 5,075,250 | | 12/1991 | Hawkins et al. | 438/21 |
| 5,081,473 | | 1/1992 | Hawkins et al. | 347/59 |

FOREIGN PATENT DOCUMENTS 62-249747 * 10/1987 (JP) ..... 346/140 R

* cited by examiner

*Primary Examiner*—John Barlow
*Assistant Examiner*—Craig A. Hallacher
(74) *Attorney, Agent, or Firm*—Oliff & Berridge, PLC

(57) ABSTRACT

The new heater element design has a pit layer which protects the overglaze passivation layer, PSG step region, portions of the Ta layer and dielectric isolation layer and junctions or regions susceptible to the cavitational pressures. Further, the inner walls of the pit layer define the effective heater area and the dopant lines define the actual heater area. In alternative embodiments, the dopant lines define the actual and effective heater areas, and an inner wall and a dopant line define the actual and effective heater areas. Further, when the new heater element designs are incorporated into printheads having full pit channel geometry and open pit channel geometry, the operating lifetime of the printhead is extended because the added protection of the pit layer prevents: 1) passivation damage and cavitational damages of the heater elements; and 2) degradation of heater robustness, hot spot formations and heater failures well into the $10^9$ pulse range. The printhead incorporating the new heater element design can be incorporated into drop-on-demand printing systems of a carriage type or a full width type.

29 Claims, 5 Drawing Sheets

THERMAL INK JET HEATER DESIGN

BACKGROUND OF THE INVENTION

1. Field of the Invention

The present invention is directed to ink jet printing systems, and in particular to drop-on-demand ink jet printing systems having printheads with heater elements.

2. Description of the Related Art

Ink jet printing systems can be divided into two types. The first type is a continuous stream ink jet printing system and the second type is a drop-on-demand printing system.

In a continuous stream ink jet printing system, ink is emitted in a continuous stream under pressure through at least one orifice or nozzle. The stream is perturbed so that the stream breaks up into droplets at a fixed distance from the orifice. At the break-up point, the droplets are charged in accordance with digital data signals and passed through an electrostatic field which adjusts the trajectory of each droplet in order to direct the ink droplets to a gutter for recirculation or to a specific location on a recording medium.

In a drop-on-demand ink jet printing system, a droplet is expelled from an orifice directly to a position on a recording medium in accordance with digital data signals. A droplet is not formed or expelled unless the droplet is to be placed on the recording medium. Because the drop-on-demand ink jet printing system requires no ink recovery, charging or deflection, such system is much simpler than the continuous stream ink jet printing system. Thus, ink jet printing systems are generally drop-on-demand ink jet printing systems.

Further, there are two types of drop-on-demand ink jet printing systems. The first type uses a piezoelectric transducer to produce a pressure pulse that expels a droplet from a nozzle. The second type uses thermal energy to produce a vapor bubble in an ink-filled channel to expel an ink droplet.

The first type of drop-on-demand ink jet printing system has a printhead with ink-filled channels, nozzles at ends of the channels and piezoelectric transducers near the other ends to produce pressure pulses. The relatively large size of the transducers prevents close spacing of the nozzles, and physical limitations of the transducers result in low ink drop velocity. Low ink drop velocity seriously diminishes the tolerances for drop velocity variation and directionality and impacts the system's ability to produce high quality copies. Further, the drop-on-demand printing system using piezoelectric transducers suffers from slow printing speeds.

Due to the above disadvantages of printheads using piezoelectric transducers, drop-on-demand ink jet printing systems having printheads which use thermal energy to produce vapor bubbles in inkfilled channels to expel ink droplets are generally used. A thermal energy generator or heater element, usually a resistor, is located at a predetermined distance from a nozzle of each one of the channels. The resistors are individually addressed with an electrical pulse to generate heat which is transferred from the resistor to the ink.

The transferred heat causes the ink to be super heated, i.e., far above the ink's normal boiling point. For example, a water based ink reaches a critical temperature of 280° C. for bubble nucleation. The nucleated bubble or water vapor thermally isolates the ink from the heater element to prevent further transfer of heat from the resistor to the ink. Further, the nucleating bubble expands until all of the heat stored in the ink in excess of the normal boiling point diffuses away or is used to convert liquid to vapor which, of course, removes heat due to heat of vaporization. During the expansion of the vapor bubble, the ink bulges from the nozzle and is contained by the surface tension of the ink as a meniscus.

When the excess heat is removed from the ink, the vapor bubble collapses on the resistor, because the heat generating current is no longer applied to the resistor. As the bubble begins to collapse, the ink still in the channel between the nozzle and bubble starts to move towards the collapsing bubble, causing a volumetric contraction of the ink at the nozzle and resulting in the separating of the bulging ink as an ink droplet. The acceleration of the ink out of the nozzle while the bubble is growing provides the momentum and velocity to expel the ink droplet towards a recording medium, such as paper, in a substantially straight line direction. The entire bubble expansion and collapse cycle takes about 20 microseconds ($\mu$s). The channel can be refired after 100 to 500 $\mu$s minimum dwell time to enable the channel to be refilled and to enable the dynamic refilling factors to be somewhat dampened.

FIG. 1 is an enlarged, cross-sectional view of a conventional heater element design. The conventional heater element 2 comprises a substrate 4, an underglaze layer 6, a resistive layer 8, a phosphosilicate glass (PSG) step region 10, a dielectric isolation layer 12, a tantalum (Ta) layer 14, addressing and common return electrodes 16, 18, an overglaze passivation layer 20, and a pit layer 22. The actual heater area is determined by the length $L_R$ of the resistive material. However, the effective heater area is determined by the distance $L_E$ between the inner slanted walls of the overglaze passivation layer. In another conventional heater element design (not shown), the side walls of the overglaze passivation do not overlap the side walls of the PSG step region, and the effective heater area is determined by the distance between the inner side walls of the PSG step region. Because there is a relatively large difference $L_D$ between the actual heater area and effective heater area, the heat generated at the unused heater areas is lost. Further, the overglaze passivation layer 20 or PSG step region 10 alone prevents exposure of the ionic and corrosive ink to the addressing and common return electrodes and/or resistor ends.

It is generally recognized in the ink jet technology that the operating lifetime of an ink jet printhead is directly related to the number of cycles of vapor bubble expansion and collapse that the heater elements can endure before failure. Further, after extended usage, the heater robustness, i.e., the printhead's ability to produce well defined ink droplets, is degraded. Heater failures and degradation of heater robustness are due to extended exposure of the heater elements to high temperatures, frequency related thermal stresses, large electrical fields and significant cavitational pressures during vapor bubble expansion and collapse. Under such environmental conditions of the heater elements, the average heater lifetime is in the high $10^7$ pulse range, i.e., number of ink droplets produced, with the first heater failure occurring as low as $3\times10^7$ pulse range.

Further, the bulk of all heater failures does not occur on the resistors 8 which vaporize the ink, but rather occurs near the junction between the resistor 8 and electrodes 16, 18. Specifically, during the collapse phase of the vapor bubble, large cavitational pressures of up to 1000 atm. impact the regions near the PSG step region 10 and overglaze passivation layer 20 of the heater. The large cavitational pressures result in attrition damage to the tantalum (Ta) layer 14 and dielectric isolation layer 12 and also attrition damage, i.e., notch damage, to the overglaze passivation layer 20 covering the PSG step region 10. Moreover, the overglaze passivation layer 20 alone protects the electrodes 16, 18 from the ionic ink, which is corrosive. Eventually, a hole in the Ta layer 14, dielectric isolation layer 12 and/or passivation layer 20 allows the ionic and corrosive ink to contact the heater at the electrodes 16, 18 to cause degradation of heater robustness and hot spot formation and eventually to heater failures.

Moreover, the heater failures are exacerbated by the problem of obtaining good conformal coverage of the Ta layer 14 over the PSG step region 10. The problem of obtaining good conformal coverage has been corrected by using an extra processing step to taper which consequentially extends the heater lifetime into the low $10^8$ pulse range. However, heater failures are still located at the PSG step region 10 and/or the overglaze passivation layer 20, and the cost of fabrication is increased by an extra processing step to obtain good conformal coverage.

Various printhead design approaches and heater constructions are disclosed in the following patents to mitigate the vulnerability of the heaters to cavitational pressures, but none of the patents discloses a heater design which removes the failure prone overglaze passivation layer 20 and/or PSG step region 10 from the region of final bubble collapse so that the PSG step region 10 and overglaze passivation layer 20 are no longer subject to the cycles of vapor bubble expansion and collapse and to the ionic and corrosive ink.

U.S. Pat. No. 4,951,063 to Hawkins et al. discloses a thermal ink jet printhead improved by a specific heating element structure and method of manufacture. The heating elements each have a resistive layer, a high temperature deposited plasma or pyrolitic silicon nitride thereover of predetermined thickness to electrically isolate a subsequently formed cavitational stress protecting layer of tantalum thereon. Such a construction lowers the manufacturing cost and concurrently provides a more durable printhead.

U.S. Pat. No. 5,041,844 to Deshpande discloses a thermal ink jet printhead having an ink channel geometry that controls the location of the bubble collapse on the heating elements. The ink channels provide the flow path between the printhead ink reservoir and the printhead nozzles. In one embodiment, the heating elements are located in a pit a predetermined distance upstream from the nozzle. The channel portion upstream from the heating element has a length and a cross-sectional flow area that is adjusted relative to the channel portion downstream from the heating element, so that the upstream and downstream portions of the channel have substantially equal ink flow impedances. This results in controlling the location of the bubble collapse on the heating element to a location substantially in the center of the heating elements.

U.S. Pat. No. 4,532,530 to Hawkins discloses a carriage type bubble ink jet printing system having improved bubble generating resistors that operate more efficiently and consume lower power without sacrificing operating lifetime. The resistor material is heavily doped polycrystalline silicon which can be formed on the same process lines with those for integrated circuits to reduce equipment costs and achieve higher yields. Glass mesas thermally isolate the active portion of the resistor from the silicon supporting substrate and from the electrode connecting points so that the electrode connection points are maintained relatively cool during operation. A thermally grown dielectric layer permits a thinner electrical isolation layer between the resistor and its protective ink interfacing tantalum layer and thus increases the thermal energy transfer to the ink.

U.S. Pat. No. 4,774,530 to Hawkins discloses an improved printhead which comprises an upper and lower substrate that are mated and bonded together with a thick insulative layer sandwiched therebetween. One surface of the upper substrate has etched therein one or more grooves and a recess, which when mated with the lower substrate, will serve as capillary filled ink channels and an ink supplying manifold, respectively. Recesses are patterned in the thick layer to expose the heating elements to the ink, thus placing them in a pit and to provide a flow path for the ink from the manifold to the channels by enabling the ink to flow around the closed ends of the channels, thereby eliminating the fabrication steps required to open the groove closed ends to the manifold recess so that the printhead fabrication process is simplified.

U.S. Pat. No. 4,835,553 to Torpey et al. discloses an ink jet printhead comprising upper and lower substrates that are mated and bonded together with a thick film insulative layer sandwiched therebetween. A recess patterned in the thick layer provides a flow path for the ink from the manifold to the channels by enabling the ink to flow around the closed ends of the channels and increase the flow area to the heating elements. Thus, the heating elements lie at the distal end of the recesses so that a vertical wall of elongated recess prevents air ingestion while it increases the ink channel flow area and decreases refill time, resulting in an increase in bubble generation rate.

U.S. Pat. No. 4,935,752 to Hawkins discloses an improved thermal ink jet printhead using heating element structures which space the portion of the heating element structures subjected to the cavitational forces produced by the generation and collapsing of the droplet expelling bubbles from the upstream interconnection to the heating element. In one embodiment, this is accomplished by narrowing the resistive area where the momentary vapor bubbles are to be produced so that a lower temperature section is located between the bubble generating region and the electrode connecting point. In another embodiment, the electrode is attached to the bubble generating resistive layer through a doped polysilicon descender. A third embodiment spaces the bubble generating portion of the heating element from the upstream electrode interface, which is most susceptible to cavitational damage, by using a resistive layer having two different resistivities.

U.S. Pat. No. 4,638,337 to Torpey et al. discloses an improved thermal ink jet printhead for ejecting and propelling ink droplets along a flight path toward a recording medium spaced therefrom in response to the receipt of the electrical input signals representing digitized data signals. The recess walls containing the heating elements prevent the lateral movement of the bubbles through the nozzle and therefore the sudden release of vaporized ink to the atmosphere, known as blow out which causes ingestion of air and interrupts the printhead operation.

The above references are incorporated by reference herein where appropriate for appropriate teachings of additional or alternative details, features and/or technical background.

OBJECTS AND SUMMARY OF THE INVENTION

It is an object of the present invention to provide an ink jet printing system having a printhead with a new heater element design for improving the heater robustness, thermal efficiency and drop generation.

It is another object of the present invention to provide an ink jet printing system having a printhead with a new heater element design to enhance the ink droplet characteristics and stability.

It is another object of the present invention to provide an ink jet printing system having a printhead with a new heater element design to retard the onset of damages caused by the cavitational pressures and corrosive ink.

It is another object of the present invention to provide an ink jet printing system having a printhead with a new heater element design extending the lifetime of the heater element.

It is another object of the present invention to provide an ink jet printing system having a printhead with a new heater element design for improving the heater efficiency.

It is a further object of the present invention to provide a new heater element design to maintain the acceptable printhead drop quality well into the $10^9$ pulse range.

It is a further object of the present invention to provide a new heater element design which shows no heater failures due to passivation damage well into the $10^9$ pulse range.

It is a further object of the present invention to provide a new heater element design which lacks any sign of cavitational damage well into the $10^9$ pulse range.

It is a further object of the present invention to provide a new heater element design to produce faster and larger droplets of ink.

It is a further object of the present invention to provide a new heater element design having an effective heater area determined by dopant lines and/or walls of the pit layer rather than by the PSG step region or the overglaze passivation layer.

To achieve the foregoing and other objects and advantages, and to overcome the shortcomings discussed above, the new heater element design has a pit layer which protects the overglaze passivation layer, PSG step region, portions of the Ta layer and dielectric isolation layer and junctions or regions susceptible to the cavitational pressures. Further, the inner walls of the pit layer define the effective heater area and the dopant lines define the actual heater area. In an alternative embodiment, the dopant lines define the actual and effective heater areas, and an inner wall and a dopant line define the actual and effective heater areas. Moreover, when the new heater element designs are incorporated into printheads having full pit channel geometry and open pit channel geometry, the operating lifetime of the printhead is extended because the added protection of the pit layer prevents: 1) passivation damage and cavitational damages of the heater elements; and 2) degradation of heater robustness, hot spot formations and heater failures well into the $10^9$ pulse range. The printhead incorporating the new heater element design can be incorporated into drop-on-demand printing systems of a carriage type or a full width type.

BRIEF DESCRIPTION OF THE DRAWINGS

The invention will be described in detail with reference to the following drawings in which like reference numerals refer to like elements, and wherein.

DETAILED DESCRIPTION OF THE PREFERRED EMBODIMENTS

Figure 1:
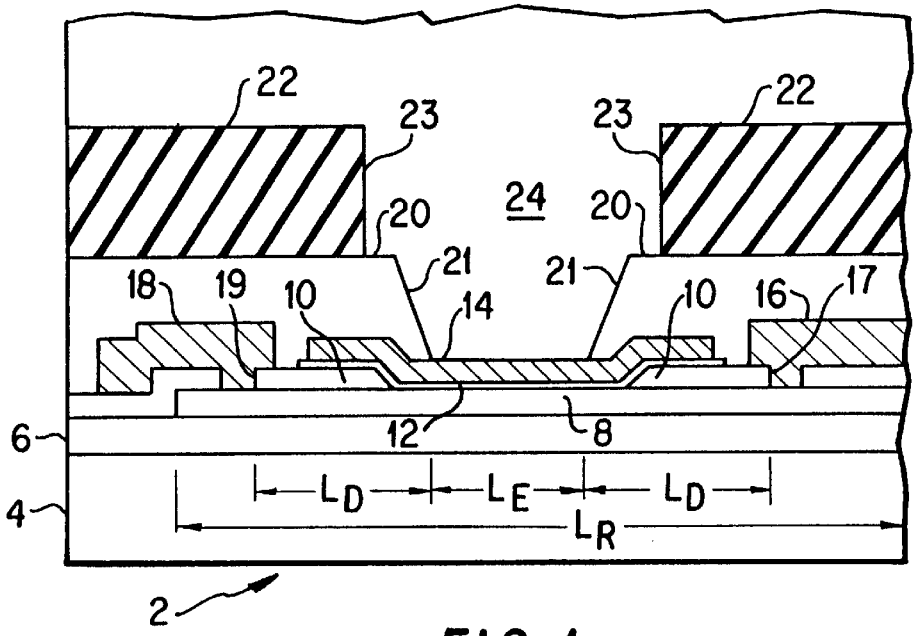
FIG. 1 PRIOR ART
FIG. 1 is an enlarged, cross-sectional view of a conventional heater element design.
Figure 2:
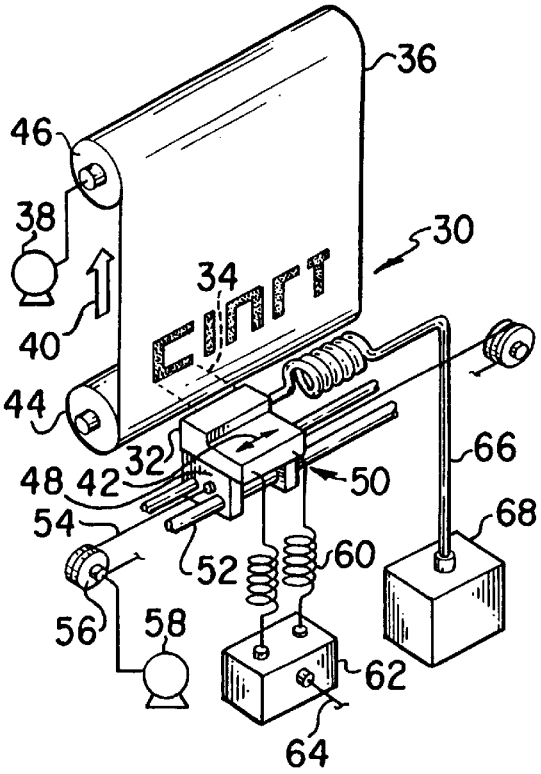
FIG. 2 is a schematic perspective of a carriage-type drop-on-demand ink jet printing system having a printhead incorporating the present invention.

FIG. 2 is a schematic perspective of a carriage-type drop-on-demand ink jet printing system 30 having a printhead 32 incorporating the present invention. A linear array of ink droplet producing channels is housed in a printhead 32 of a reciprocating carriage assembly. Ink droplets 34 are propelled a preselected distance to a recording medium 36 which is stepped by a stepper motor 38 in the direction of an arrow 40 each time the printhead 32 traverses in one direction across the recording medium 36 in the direction of the arrow 42. The recording medium 36, such as paper, is stored on a supply roll 44 and stepped onto a roll 46 by the stepper motor 38 by means well known in the art. Further, it can be appreciated that sheets of paper can be used by using feeding mechanisms that are known in the art.

The printhead 32 is fixedly mounted on a support base 48 to comprise the carriage assembly 50. The carriage assembly 50 is movable back and forth across the recording medium 36 in a direction parallel thereto by sliding on two parallel guide rails 52 and perpendicular to the direction in which the recording medium 36 is stepped. The reciprocal movement of the printhead 32 is achieved by a cable 54 and a pair of rotatable pulleys 56, one of which is powered by a reversible motor 58.

The conduits 60 from a controller 62 provide the current pulses to the individual resistors in each of the ink channels. The current pulses which produce the ink droplets are generated in response to digital data signals received by the controller 62 through an electrode 64. A hose 66 from an ink supply 68 supplies the channel with ink during the operation of the printing system 30.

Figure 3:
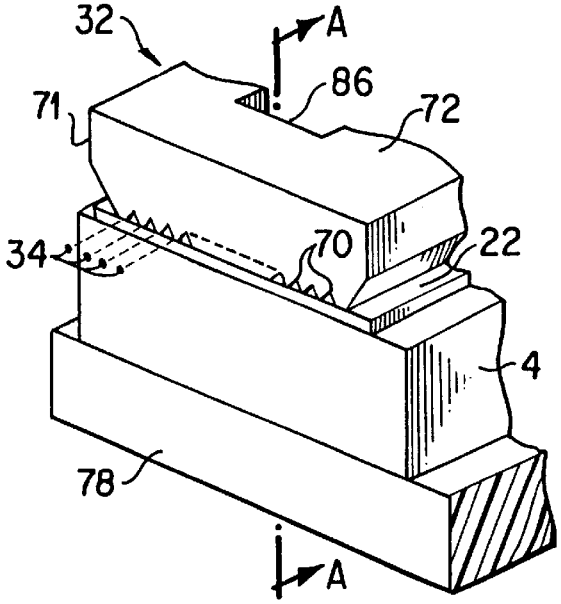
FIG. 3 is an enlarged schematic isometric view of the printhead illustrated in FIG. 2.

FIG. 3 is an enlarged schematic isometric view of the printhead 32 illustrated in FIG. 2 which shows the array of nozzles 70 in a front face 71 of a channel plate 72 of the printhead 32. Referring also to FIGS. 4 and 6, which are cross-sectional views along a view line A—A, a lower electrically insulating substrate 4 has heater elements and terminals 82 patterned on a surface thereof while a channel plate 72 has parallel grooves 74 which extend in one direction and penetrate through a front face 71 of the channel plate 72. The other end of grooves 74 terminate at a slanted wall 76.

The surface of the channel plate 72 and grooves 74 are aligned and bonded to the substrate 4 so that the plurality of heater elements 1 is positioned in each channel 75 formed by the grooves 74 and the substrate 4. The printhead 32 is mounted on a metal substrate 78 containing insulated electrodes 80 which are used to connect the heater elements to the controller 62. The metal substrate 78 serves as a heat sink to dissipate heat generated within the printhead 32. The electrodes 16, 18 on the substrate 4 terminate at the terminals 82. The channel plate 72 is smaller than that of the substrate 4 in order that the electrode terminals 82 are exposed and available for connection to the controller 62 via the electrodes 80 on the metal substrate 78.

An internal recess serves as an ink supply manifold 84 for the ink channels. The ink supply manifold 84 has an open bottom for use as an ink fill hole 86, and ink enters the manifold 84 through the fill hole 86 and fills each channel 75 by capillary action. The ink at each nozzle 70 forms a meniscus at a slight negative pressure which prevents the ink from weeping therefrom.

Figure 4A:
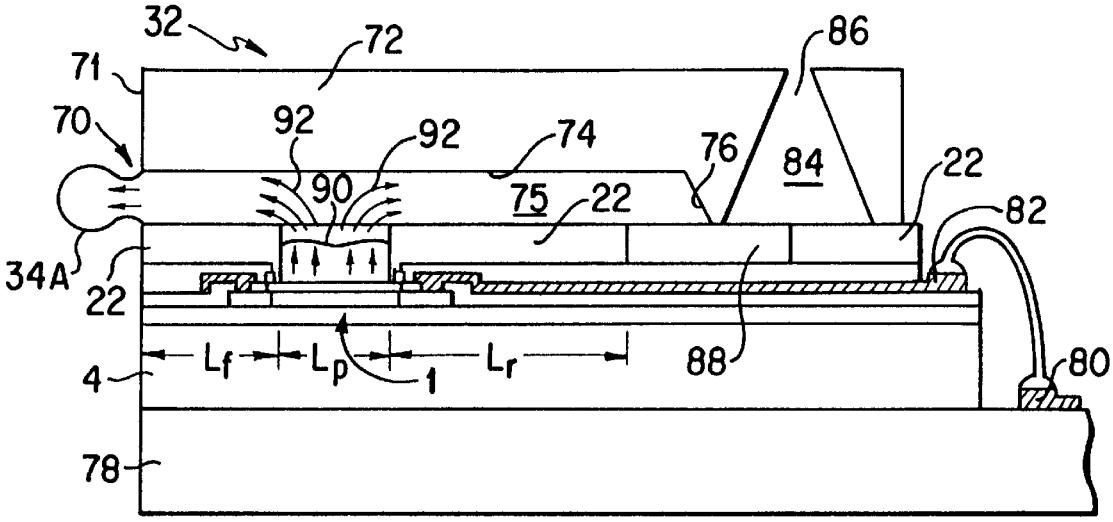
FIGS. 4A and 4B illustrate the expansion and collapse of the vapor bubble, respectively, in a full pit channel geometry of a printhead with the new heater element designs of the present invention along a view line A—A of FIG. 3.
Figure 6A:
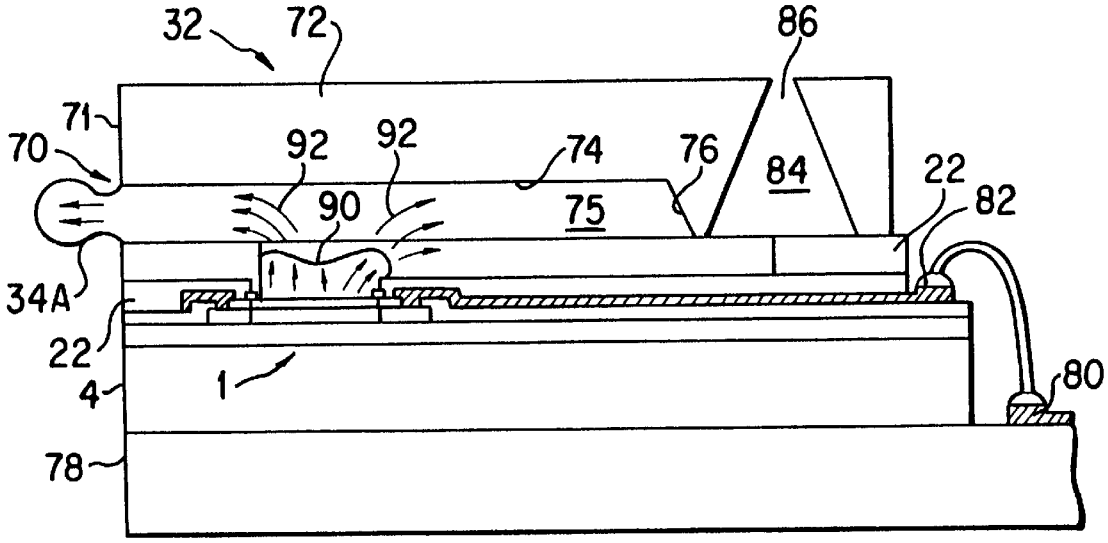
FIGS. 6A and 6B illustrate the expansion and collapse of the vapor bubble, respectively, in an open pit channel geometry of a printhead incorporating the new heater element designs of the present invention along a view line A—A of FIG. 3.
Figure 6B:
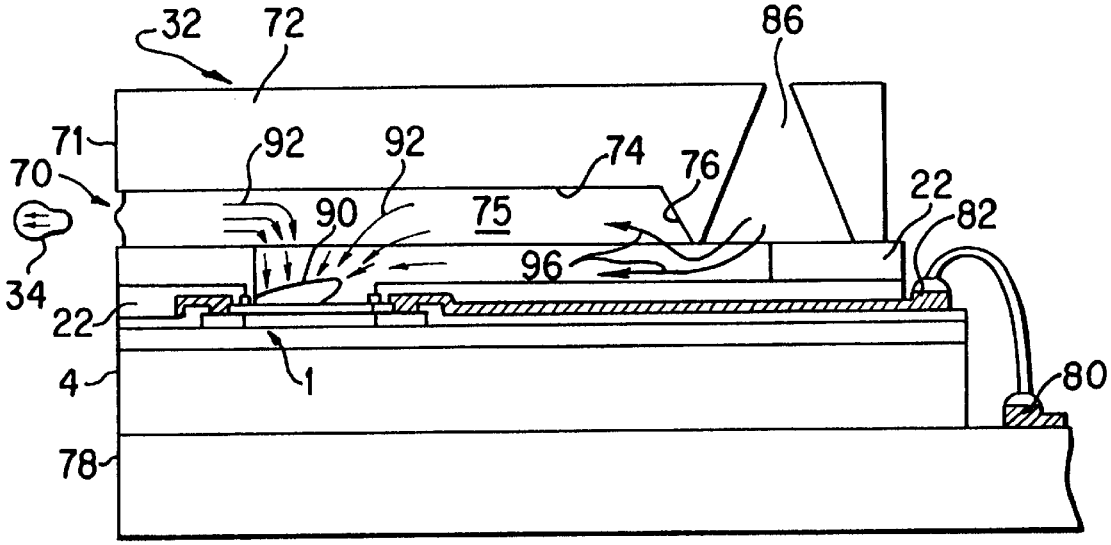

FIGS. 4A and 6A illustrate the growth of ink droplet ejecting vapor bubbles of ink jet printhead with a full pit channel geometry and open pit channel geometry, respectively, incorporating the heater element designs of the present invention. Further, FIGS. 4B and 6B illustrate the cavitational pressure producing collapse in a printer having full pit channel geometry and open pit channel geometry, respectively, incorporating the heater element designs of the present invention.

Figure 4B:
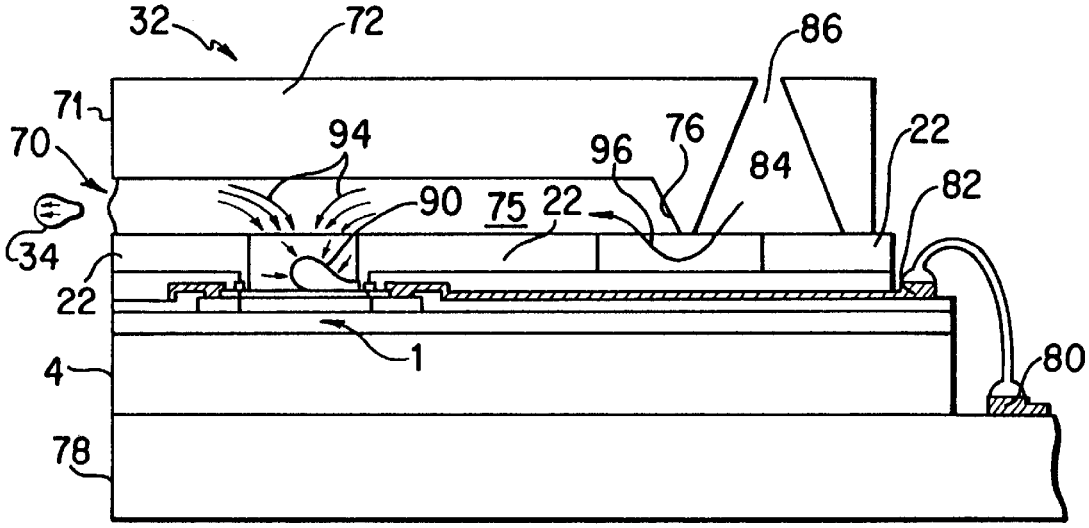
Figure 5A:
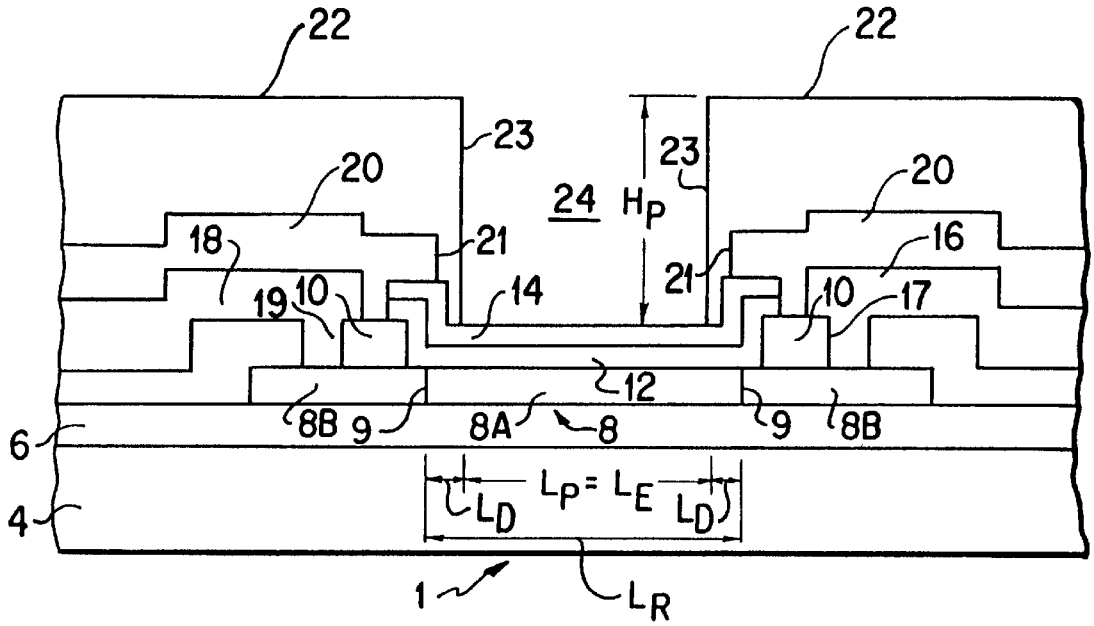
FIGS. 5A and 5B are enlarged, cross-sectional views of the new heater element designs of the present invention for use in printheads with full pit channel geometry.

In a full pit channel geometry as shown in FIGS. 4A and 4B which incorporate the heater element design of FIG. 5A, the thick film insulative layer 22, i.e., pit layer, is patterned to form a common recess 88 and a pit 24 that exposes the heater element 1 to the ink. The channel 75 comprises a front channel length ($L_f$) downstream of the heating element, a rear channel length ($L_r$) upstream of the heating elements, and a pit length ($L_p$) covering the portion of the channel 75 containing the heater element 1. During the expansion of a vapor bubble 90, the ink is pushed away from the pit so that the ink flows out through the front channel portion and also flows towards the reservoir at the end of the rear channel portion as indicated by the arrows 92. The ink flow to the front channel portion causes the ink to bulge from the nozzle as a protrusion 34A.

Figure 5B:
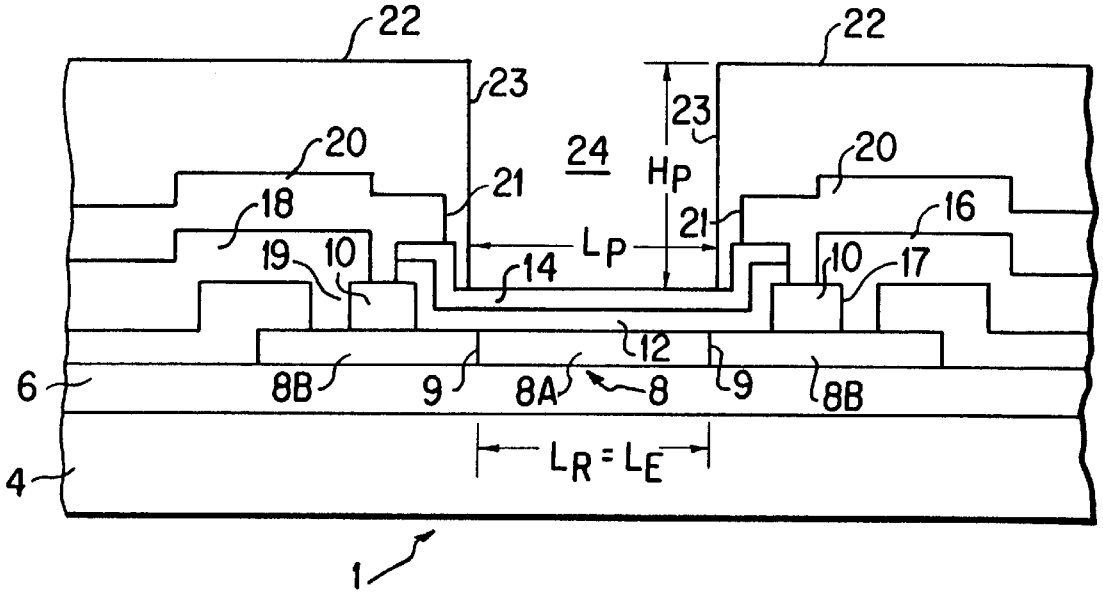

As the vapor bubble 90 collapses, an ink droplet 34 is ejected as shown in FIG. 4B. Further, the ink moves into the pit 24 from both the front and rear channel portions as shown by arrows 94, and from the manifold 84 as shown by an arrow 96. Because $L_r$ is larger than $L_f$ and they both have the same flow area, the ink flowing from the rear channel portion has higher flow resistance than ink flowing from the front channel portion. As a result, more ink moves into the pit 24 from the front channel portion and such ink flow pushes the collapsing vapor bubble 90 to the junction between the resistor 8 and addressing electrode 16 and the region near the PSG step region 10 (FIGS. 5A and 5B). Thus, the overglaze passivation layer 20, PSG step region 10 and portions of Ta and dielectric isolation layers 12, 14 near the PSG step region 10 of the addressing electrode 16 are subjected to large cavitational pressures.

FIGS. 5A and 5B are enlarged, cross-sectional views of new heater element designs of the present invention. The heater element is formed on an underglaze layer 6 of a substrate 4. Polysilicon is deposited on top of the underglaze layer and etched to form a resistor 8. The resistor has a lightly doped n-type region 8A with two heavily doped n-type regions 8B formed at ends of the lightly doped n-type region 8A. The interfaces between the heavily doped and lightly doped regions define dopant lines 9. The dopant lines 9 define the actual heater area of the heater element.

A reflow phosphosilicate glass (PSG) is formed on top of the resistor 8 and etched to form the PSG step regions 10 which expose a top surface of the resistor 8 and electrode vias 17, 19 for the addressing and common return electrodes 16, 18. A dielectric isolation layer 12 is formed on top of the resistor 8 to electrically isolate the resistor 8 from the ink. A tantalum (Ta) layer 14 is sputter deposited on the dielectric isolation layer 12 to protect the dielectric isolation layer 12 from the heat and cavitational pressures. The dielectric isolation and Ta layers 12, 14 are etched and aluminum (Al) is metallized and etched to form the addressing electrode 16 and common return electrode 18. For an overglaze passivation layer 20, a thick composite layer of phosphorus doped CVD silicon dioxide and $Si_3N_4$ is deposited over the entire substrate and etched to expose the Ta layer 14. Finally, a thick insulative layer is deposited over the entire substrate and etched to form the pit layer 22 and define the pit 24 and pit length $L_p$.

In both of the heater element designs illustrated at 5A and 5B, the pit length $L_p$ is defined by the inner walls 23 of the pit layer 22. Further, the pit layer 22 has an inner wall height $H_p$ which is higher than the inner wall height of conventional heater element designs. In the preferred embodiment, the inner wall height is about 35 $\mu$m. Further, the new heater element design extends the inner walls of the pit layer 22 beyond the inner ends of the overglaze passivation layer 20, Ta layer 14, dielectric isolation layer 12 and PSG step region 10 to provide an added protection to prevent damage of junctions and regions susceptible to the cavitational pressures. Further, PSG step region 10 and the overglaze passivation 20 no longer define the effective heater area. In the preferred embodiment, the inner walls 23 of the pit layer 22 define the effective heater area and the dopant lines 9 define the actual heater area.

In FIG. 5A, the difference between the actual heater area and effective heater area is reduced relative to the conventional heater element design. Further, as shown in FIG. 5B and FIG. 7B, the effective and actual heater areas are defined by the dopant lines 9 and thus, the unused heater area is eliminated. Such efficient use of the heater increases the efficiency of the heater elements because less of the heat generated by the heater is lost and the heat generating pulse currents are efficiently used.

Figure 7A:
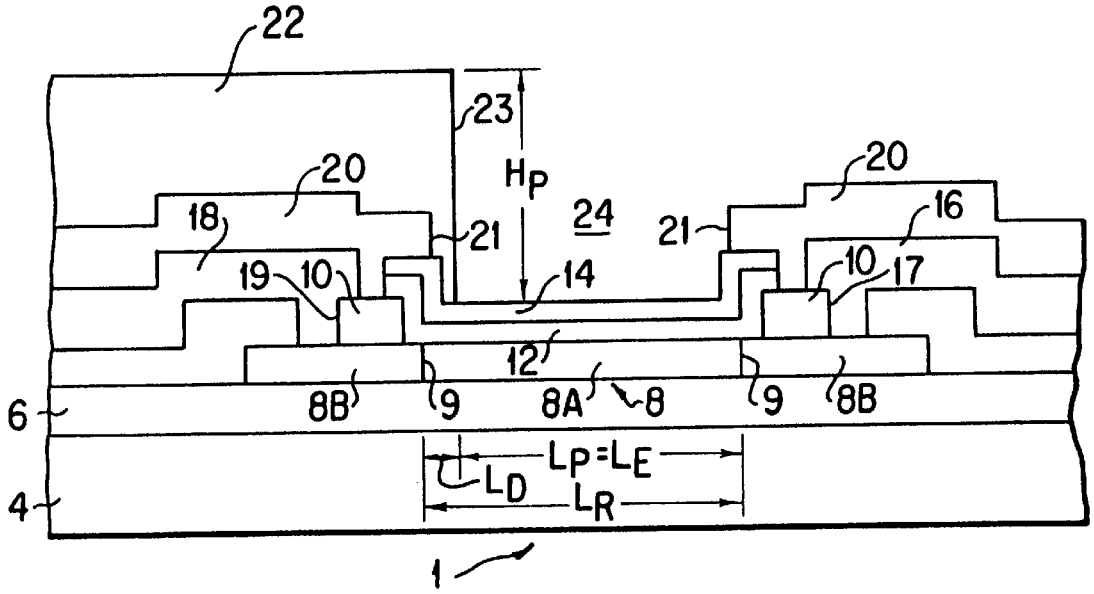
FIGS. 7A and 7B are enlarged, cross-sectional views of the new heater element designs of the present invention for use in printheads with open pit channel geometry.
Figure 7B:
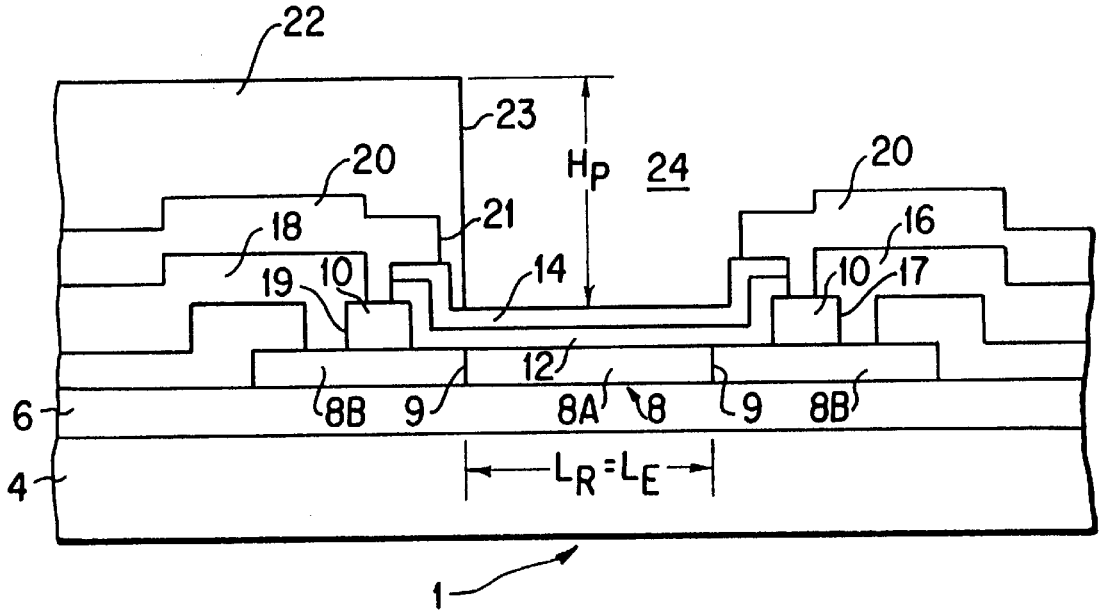

In the open pit channel geometry as shown in FIGS. 6A and 6B which incorporate the heater design of FIG. 7A, the rear channel portion has a larger cross-sectional flow area than the front channel portion because the thick insulative layer 22 is removed from the rear channel portion. The ink is pushed away through both front and rear channel portions as in the full pit geometry of FIG. 5A and shown by arrows 92. However, the ink flow is different during the bubble collapse. In the open pit channel geometry, the ink in the rear channel portion has a lower fluid flow resistance than the ink in the front channel portion. As a result, more ink moves into the pit from the rear portion and such ink flow pushes the collapsing vapor bubble to the junction between the resistor 8 and the common return electrode 18 and regions near the PSG step region 10.

Thus, the overglaze passivation layer 20 and PSG step region 10 and portions of Ta and dielectric isolation layers 12, 14 near the PSG step region 10 of the common return electrode 18 are subjected to large cavitational pressures.

FIGS. 7A and 7B are enlarged, cross-sectional views of the new heater element design of the present invention for use in an open pit channel geometry. As shown, the designs are nearly identical to FIGS. 5A and 5B except that the pit layer 22 over the addressing electrode 16 has been removed. As discussed, the inner wall 23 of the pit layer provides added protection to prevent damages to junctions and regions susceptible to the cavitational forces. Further, in FIG. 7A, the effective heater area is defined by an inner wall 23 of the pit layer and the dopant line 9 of the addressing electrode 16 and thus, the unused heater area is relatively small. In FIG. 7B, the effective and actual heater elements are defined by the dopant lines 9 as in FIG. 6B.

In the new heater element design of FIGS. 5A, 5B, 7A and 7B, the use of the dopant lines 9 and inner walls 23 of the pit layer 22 adds additional flexibility to the design of the heater elements 1. For example, the dopant lines 9 are laterally movable dependent upon the size of the mask to form the heavily doped n-type region. Further, the inner wall(s) 23 of the pit layer 22 is laterally movable. By laterally moving the dopant lines 9 and inner wall(s) 23, various heater elements requiring different heater area can be quickly and easily designed for different printheads.

The following describes the various methods and materials used to form the heater elements of designs illustrated in FIGS. 5A, 5B, 7A and 7B. The heater element design of FIGS. 5A and 5B and FIGS. 7A and 7B are substantially similar except for the pit layer. In the heater element designs, the substrate 4 is silicon. Silicon is preferably used because it is electrically insulative and has good thermal conductivity for the removal of heat generated by the heater elements. The substrate is a (100) double side polished P-type silicon and has a thickness of 525 micrometers ($\mu$m). Further, the substrate 4 can be lightly doped, for example, to a resistivity of 5 ohm-cm degenerately doped to a resistivity between 0.01 to 0.001 ohm-cm to allow for a current return path or degenerately doped with an epitaxial, lightly doped surface layer of 2 to 25 $\mu$m to allow fabrication of active field effect or bipolar transistors.

The underglaze layer 6 is preferably made of silicon oxide ($SiO_2$) which is grown by thermal oxidation of the silicon substrate. However, it can be appreciated that other suitable thermal oxide layers can be used for the underglaze layer 6. The underglaze layer 6 has a thickness between 1 to 2 $\mu$m and in the preferred embodiment has a thickness of 1.5 $\mu$m.

A resistive material is deposited on top of the underglaze by a chemical vapor deposition (CVD) of polysilicon up to a thickness between 1,000 to 6,000 angstroms (Å) to form the resistor 8. In the preferred embodiment, the resistor 8 has a thickness between 4,000 Å to 5,000 Å and preferably has a thickness of 4,500 Å. Polysilicon is initially lightly doped using either ion implantation or diffusion. Then, a mask is used to further heavily dope the ends of the resistor 8 by ion implantation or diffusion. Either wet or dry etching is used to remove excess polysilicon to achieve the proper length of the resistor 8. Further, the polysilicon can be simultaneously used to form elements of associated active circuitry, such as, gates for field effect transistors and other first layer metallization.

The PSG step region 10 is formed of 7.5 wt. % PSG. To form the PSG, $SiO_2$ is deposited by CVD or is grown by thermal oxidation and the $SiO_2$ is doped with 7.5 wt. % phosphorus. The PSG is heated to reflow the PSG and create a planar surface to provide a smooth surface for aluminum metallization for the address and common return electrodes 16, 18. The PSG layer is etched to provide the vias 17, 19 for the addressing and common return electrodes 16, 18 and to provide the surface for the dielectric isolation and Ta layers 12, 14.

The dielectric isolation layer 12 is formed by pyrolytic chemical vapor deposition of silicon nitride ($Si_3N_4$) and etching of the $Si_3N_4$. The $Si_3N_4$ layer, which has been directly deposited on the exposed polysilicon resistor, has a thickness of 500 to 2,500 Å and preferably about 1,500 Å. The pyrolytic silicon nitride has a very good thermal conductivity for efficient transfer of heat between the resistor and the ink when directly deposited in contact with the resistor.

Alternatively, the dielectric isolation layer 12 can be formed by thermal oxidation of the polysilicon resistors to form $SiO_2$. The $SiO_2$ dielectric layer can be grown to a thickness of 500 Å to 1 $\mu$m and in the preferred embodiment has a thickness from 1,000 to 2,000 Å.

The Ta layer 14 is sputter deposited on top of the dielectric isolation layer 12 by chemical vapor deposition and has a thickness between 0.1 to 1.0 $\mu$m. The Ta layer 14 is masked and etched to remove the excess tantalum and then the dielectric isolation layer 12 is also etched prior to metallization of the addressing and common return electrodes 16, 18.

The addressing and common return electrodes 16, 18 are formed by chemical vapor deposition of aluminum into the vias 17, 19 and etching the excess aluminum. The addressing and common return electrode terminals 82 are positioned at predetermined locations to allow clearance for electrical connection to the control circuitry after the channel plate 72 is attached to the substrate 4. The addressing and common return electrodes 16, 18 are deposited to a thickness of 0.5 to 3 $\mu$m, with a preferred thickness being 1.5 $\mu$m.

The overglaze passivation layer 20 is formed of a composite layer of PSG and $Si_XN_Y$. The cumulative thickness of the overglaze passivation layer can range from 0.1 to 10 $\mu$m and the preferred thickness being 1.5 $\mu$m. A PSG having preferably with 4 wt. % phosphorus is deposited by low temperature chemical vapor deposition (LOTOX) to a thickness of 5,000 Å. Next, silicon nitride is deposited by plasma assisted chemical vapor deposition to a thickness of 1.0 $\mu$m. Using a passivation mask, the silicon nitride is plasma etched and the PSG is wet etched off the heater element to expose the Ta layer 14 and terminals 82 of the addressing and common return electrodes 16, 18 for electrical connection to the controller 62. In an alternative embodiment, the overglaze passivation layer 20 can be formed entirely of PSG. Further, the overglaze passivation layer 20 can be formed of either of the above arrangements with an additional composite layer of polyimide with 1 to 10 $\mu$m thickness deposited over the PSG or silicon nitride layer(s).

Next, a thick film insulative layer such as, for example, RISTON®, VACREL®, PROBIMER 52®, or polyimide is formed on the entire surface of the substrate. The thick insulative layer 22 is photolithographically processed to enable the etching and removal of those portions of the thick insulative layer over each heater element 1 and comprises a pit layer 22 for each heater element 1. In the heater element designs of FIGS. 5A and 5B, the thick film insulative layer 22 is removed to form the pit 24 and the common recess 88. In the heater designs of FIGS. 7A and 7B, the thick film insulative layer 22 is removed to form part of the pit 24 and the channels 75. Further, the inner walls 23 of the pit layer 22 inhibit lateral movement of each vapor bubble 90 generated by the heater and thus prevents the phenomenon of blow-out. As discussed above, the inner walls 23 of the pit layer 22 extend beyond the side walls of the PSG step region 10 and the overglaze passivation layer 20 to provide added protection against cavitational pressures.

With the heater element design of FIGS. 5A, 5B, 7A and 7B, the ink droplet characteristics and stability at $10^9$ pulse range remained essentially unchanged from the initial ink droplet characteristics and stability. For a particular geometry tested, which is shown in FIG. 5A, after $1.6\times10^9$ pulse, the droplet characteristics were: 1) velocity of 10 m/s; 2) drop volume of 130 picoliters; 3) velocity jitter of less than 4%; 4) transit time variability across the printhead of less than 5%; and 5) crisp threshold response with a slight increase of threshold value of about 9%. Further, the new heater element designs showed no signs of heater failures caused by cavitational pressure well into the $10^9$ pulse range.

Moreover, the new heater element designs are more efficient because the new heater element designs produce larger ink droplets 10–15% faster when the same amount of heat generating pulse currents were applied as the conventional heater elements.

The foregoing embodiments are intended to be illustrative and not limiting. For example, the present invention is also applicable to printing systems which use a full-width printhead. Thus, various modifications may be made without departing from the spirit and scope of the present invention as defined in the appended claims.

What is claimed is:

1. A heater element for use in a printhead of a printing system to expel ink onto a recording medium by expansion and collapse of a vapor bubble comprising:

a substrate;

a resistive layer formed over said substrate, the resistive layer having contact regions;

contact means for contacting said resistive layer at the contact regions;

insulation means for electrically isolating and chemically protecting the resistive layer and formed over said resistive layer, said insulation means forming a bottom wall of a pit and protecting said resistive layer from corrosion caused by the ink;

a first insulative film formed over the contact means and first edge portions of the insulation means; and a second insulative film formed over at least a portion of the first insulative film and at least a second edge portion of the insulation means, said second insulative film having at least one inner wall and a top surface, both said at least one inner wall and said top surface being exposed to the ink, said at least one inner wall forming a side wall of the pit and extending to the bottom wall of said pit, said top surface defining a lower surface of an ink channel, said pit being formed directly above said resistive layer and exposing a surface of said insulation means for transferring energy generated by said resistive layer to the ink, said second insulative film inner wall protecting the first insulative film from erosion by cavitational pressures generated in the pit during collapse of the vapor bubble.

2. The heater element of claim 1, wherein said substrate comprises an electrically insulative and thermally conductive substrate and an oxide layer.

3. The heater element of claim 1, wherein said contact means comprises a PSG layer and an electrode formed on each end of said resistive layer, said PSG layer having a via for said electrode to contact said resistive layer.

4. The heater element of claim 1, wherein said insulation means comprises at least one of dielectric and oxide layers formed on top of said resistive layer and further comprising a protective layer to prevent damage of said at least one of said dielectric and oxide layers from the ink and cavitational pressures generated during the collapse of the vapor bubble.

5. The heater element of claim 1, wherein said at least one inner wall comprises a first wall and a second wall, said first and second walls forming a recess to expose said insulation means and defining a region of energy transfer between said resistive layer and the ink.

6. The heater element of claim 1, wherein said insulative film prevents passivation and cavitational damages of said first heater element well into a $10^9$ pulse range.

7. The heater element of claim 1, wherein said insulative film prevents degradation of heater robustness, hot spot formations and heater failures well into a $10^9$ pulse range.

8. A printhead for use in a printing system to expel ink droplets onto a recording medium by expansion and collapse of vapor bubbles, comprising:

a channel plate haying a plurality of channels and having a manifold for supplying ink to said channels, first ends of said plurality of channels forming nozzles for expelling the ink droplets and second ends of said plurality of channels being in communication with said manifold to supply ink to said plurality of channels;

a first substrate coupled to said channel plate and having a plurality of heater elements corresponding in number and location to said plurality of channels in said channel plate and a first plurality of terminals, each heater element being located at a predetermined distance from each nozzle and comprising:

a) a resistive layer formed over said substrate, the resistive layer having contact regions;

b) contact means for contacting said resistive layer and said plurality of terminals, the contact means contacting the resistive layer at the contact regions;

c) insulation means for electrically isolating and chemically protecting the resistive layer and formed over said resistive layer, said insulation means forming a bottom of a pit and protecting said resistive layer from corrosion caused by the ink;

d) a first insulative film formed over the contact means and first edge portions of the insulation means;

e) a second insulative film formed over at least a portion of the first insulative film and at least a second edge portion of the insulation means, said second insulative film having at least one inner wall and a top surface, both said at least one inner wall and said top surface being exposed to the ink, said at least one inner wall forming a side wall of the pit and extending to the bottom of said pit, said top surface defining a lower surface of an ink channel, said pit being directly above said resistive layer and exposing a surface of said insulation means for transferring energy generated by said resistive layer to the ink, said second insulative film inner wall protecting the the first insulative film from erosion by cavitational pressures generated in the pit during collapse of the vapor bubble; and a second substrate coupled to said first substrate and opposite of said channel plate, said second substrate having a second plurality of terminals coupled to said first plurality of terminals and to a controller for sending electrical pulses to selected resistive layers of said plurality of heater elements, said resistive layers generating heat in response to the electrical pulses and causing the expansion and growth of the vapor bubbles for ejection of the ink droplets at said nozzle of said printhead.

9. The printhead of claim 8, wherein said at least one inner wall comprises a first wall and a second wall, said first and second walls forming a recess to expose said insulation means and defining a region of energy transfer between said resistive layer and the ink.

10. The printhead of claim 8, wherein said first a second insulative film prevents passivation and cavitational damages of said heater element well into a $10^9$ pulse range to extend an operating lifetime of said printhead.

11. The printhead of claim 8, wherein said first and second insulative film prevents degradation of heater robustness, hot spot formations and heater failures well into a $10^9$ pulse range to extend an operating lifetime of said printhead.

12. A printing system for recording onto a surface of a medium comprising:

a printhead having a plurality of nozzles and having a plurality of heater elements for causing expansion and collapse of vapor bubbles to expel ink from said nozzles onto the medium, each heater element comprising:

a) a substrate;

b) a resistive layer formed over said substrate, the resistive layer having contact regions and an active heater region;

c) contact means for contacting said resistive layer at the contact regions;

d) insulation means for electrically isolating and chemically protecting the resistive layer and formed over said resistive layer, said insulation means forming a bottom of a pit and protecting said resistive layer from corrosion caused by the ink;

e) a first insulative film formed over the contact means and first edge portions of the insulation means;

f) a second insulative film formed over at least a portion of the first insulative film and at least a second edge portion of the insulation means, said second insulative film having at least one inner wall and a top surface, both said at least one inner wall and said top surface being exposed to the ink, said at least one inner wall forming a side wall of the pit and extending to the bottom of the pit, said top surface defining a lower surface of an ink channel, the pit being directly above said resistive layer and exposing a surface of said second insulation means for transferring energy generated by said resistive layer to the ink, said insulative film inner wall protecting the first insulative film from erosion by cavitational pressures generated in the pit during collapse of the vapor bubble;

means for supplying ink to said printhead; and controlling means for controlling the ejection of ink coupled to said printhead, said controlling means applying electrical pulses to said contact means of said heater elements selected in accordance with signals received by said controlling means, said electrical pulses causing said resistive layers of the selected heater elements to generate energy for transfer to the ink and the energy causing expansion and collapse of vapor bubbles to expel ink at said nozzles of said printhead to the surface of the medium.

13. The printing system of claim 12, further comprising:

a base coupled to said printhead, said base being adapted for at least one of reciprocal movement parallel to a surface of the medium and perpendicular to a direction of movement thereof; and means for moving the medium so that the medium is moved a predetermined distance for printing one line at a time by said printhead.

14. The printing system of claim 12, wherein said at least one inner wall comprises a first wall and a second wall, said first and second walls forming a recess to expose said insulation means and defining a region of energy transfer between said resistive layer and the ink.

15. The printing system of claim 12, wherein said first and second insulative film prevents passivation and cavitational damages of said heater element well into a $10^9$ pulse range to extend an operating lifetime of the printhead.

16. The printing system of claim 12, wherein said first and second insulative film prevents degradation of heater robustness, hot spot formations and heater failures well into a $10^9$ pulse range to extend an operating lifetime of the printhead.

17. The printing system of claim 12, wherein said printhead further comprises a channel plate, said channel plate having a plurality of channels and having a manifold for receiving ink from said supplying means to said plurality of channels and ends of said plurality of channels forming said nozzles, said substrate being coupled to said channel plate with said heater elements corresponding in number and location to said plurality of channels in said channel plate.

18. A heater element for use in a printhead of a printing system to expel ink onto a recording medium by expansion and collapse of a vapor bubble comprising:

a substrate;

a resistive layer formed over said substrate, the resistive layer having contact regions;

contact means for contacting said resistive layer at the contact regions;

insulation means for electrically isolating and chemically protecting the resistive layer and formed over said resistive layer, said insulation means forming a bottom wall of a pit and protecting said resistive layer from corrosion caused by the ink;

a first insulative film formed over the contact means and first edge portions of the insulation means; and a second insulative film formed over at least a portion of the first insulative film and at least a second edge portion of the insulation means, said second insulative film having at least one inner wall and a top surface, both said at least one inner wall and said top surface being exposed to the ink, said at least one inner wall forming a side wall of the pit and extending to the bottom wall of said pit, said top surface defining a lower surface of an ink channel, said pit being formed directly above said resistive layer and exposing a surface of said insulation means for transferring energy generated by said resistive layer to the ink, said second insulative film inner wall protecting the first insulative film from erosion by cavitational pressures generated in the pit during collapse of the vapor bubble, wherein said resistive layer comprises a polysilicon layer having a lightly doped region with two ends and a heavily doped region at each end of said lightly doped region, said heavily doped regions being coupled to said contact means and interfaces between said lightly doped region and said heavily doped regions define first and second dopant lines.

19. The heater element of claim 18, wherein said at least one inner wall of said insulative film extends beyond said second first dopant line.

20. The heater element of claim 18, wherein said at least one inner wall and said second dopant line define a region of energy transfer between said lightly doped region of said resistive layer and the ink.

21. The heater element of claim 18 wherein said lightly doped region defines a region of energy transfer between said resistive layer and the ink.

22. A printhead for use in a printing system to expel ink droplets onto a recording medium by expansion and collapse of vapor bubbles, comprising:

a channel plate having a plurality of channels and having a manifold for supplying ink to said channels, first ends of said plurality of channels forming nozzles for expelling the ink droplets and second ends of said plurality of channels being in communication with said manifold to supply ink to said plurality of channels;

a first substrate coupled to said channel plate and having a plurality of heater elements corresponding in number and location to said plurality of channels in said channel plate and a first plurality of terminals, each heater element being located at a predetermined distance from each nozzle and comprising:

a) a resistive layer formed over said substrate, the resistive layer having contact regions;

b) contact means for contacting said resistive layer and said plurality of terminals, the contact means contacting the resistive layer at the contact regions;

c) insulation means for electrically isolating and chemically protecting the resistive layer and formed over said resistive layer, said insulation means forming a bottom of a pit and protecting said resistive layer from corrosion caused by the ink;

d) a first insulative film formed over the contact means and first edge portions of the insulation means;

e) a second insulative film formed over at least a portion of the first insulative film and at least a second edge portion of the insulation means, said second insulative film having at least one inner wall and a top surface, both said at least one inner wall and said top surface being exposed to the ink, said at least one inner wall forming a side wall of the pit and extending to the bottom of said pit, said top surface defining a lower surface of an ink channel, said pit being directly above said resistive layer and exposing a surface of said insulation means for transferring energy generated by said resistive layer to the ink, said second insulative film inner wall protecting the first insulative film from erosion by cavitational pressures generated in the pit during collapse of the vapor bubble; and a second substrate coupled to said first substrate and opposite of said channel plate, said second substrate having a second plurality of terminals coupled to said first plurality of terminals and to a controller for sending electrical pulses to selected resistive layers of said plurality of heater elements, said resistive layers generating heat in response to the electrical pulses and causing the expansion and growth of the vapor bubbles for ejection of the ink droplets at said nozzle of said printhead, wherein said resistive layer comprises a polysilicon layer having a lightly doped region with two ends and a heavily doped region at each end of said lightly doped region, said heavily doped regions coupled to said contact means and interfaces between said lightly doped region and said heavily doped regions define first and second dopant lines.

23. The printhead of claim 22, wherein said at least one inner wall of said second insulative film extends beyond first dopant line.

24. The printhead of claim 22, wherein said at least one inner wall and said second dopant line define a region of energy transfer between said lightly doped region of said resistive layer and the ink.

25. The printhead of claim 22, wherein said lightly doped region defines a region of energy transfer between said resistive layer and the ink.

26. A printing system for recording onto a surface of a medium comprising:

a printhead having a plurality of nozzles and having a plurality of heater elements for causing expansion and collapse of vapor bubbles to expel ink from said nozzles onto the medium, each heater element comprising:

a) a substrate;

b) a resistive layer formed over said substrate, the resistive layer having contact regions and an active heater region;

c) contact means for contacting said resistive layer at the contact regions;

d) insulation means for electrically isolating and chemically protecting the resistive layer and formed over said resistive layer, said insulation means forming a bottom of a pit and protecting said resistive layer from corrosion caused by the ink;

e) a first insulative film formed over the contact means and first edge portions of the insulation means;

f) a second insulative film formed over at least a portion of the first insulative film and at least a second edge portion of the insulation means, said second insulative film having at least one inner wall and a top surface, both said at least one inner wall and said top surface being exposed to the ink, said at least one inner wall forming a side wall of the pit and extending to the bottom of the pit, said top surface defining a lower surface of an ink channel, the pit being directly above said resistive layer and exposing a surface of said second insulation means for transferring energy generated by said resistive layer to the ink, said insulative film inner wall protecting the first insulative film from erosion by cavitational pressures generated in the pit during collapse of the vapor bubble;

means for supplying ink to said printhead; and controlling means for controlling the ejection of ink coupled to said printhead, said controlling means applying electrical pulses to said contact means of said heater elements selected in accordance with signals received by said controlling means, said electrical pulses causing said resistive layers of the selected heater elements to generate energy for transfer to the ink and the energy causing expansion and collapse of vapor bubbles to expel ink at said nozzles of said printhead to the surface of the medium, wherein said resistive layer comprises a polysilicon layer having a lightly doped region with two ends and a heavily doped region at each end of said lightly doped region, said heavily doped regions coupled to said contact means and interfaces between said lightly doped region and said heavily doped regions define first and second dopant lines.

27. The printing system of claim 26, wherein said at least one inner wall of said second insulative film extends beyond first dopant line.

28. The printing system of claim 26, wherein said at least one inner wall and said second dopant line define a region of energy transfer between said lightly doped region of said resistive layer and the ink.

29. The printing system of claim 26, wherein said lightly doped region defines a region of energy transfer between said resistive layer and the ink.

* * * * *